US011641987B1

(12) United States Patent
De Jesus

(10) Patent No.: US 11,641,987 B1
(45) Date of Patent: May 9, 2023

(54) TOILET SEAT HAVING SUCTION ASSEMBLY

(71) Applicant: Marcelo A. De Jesus, Miami, FL (US)

(72) Inventor: Marcelo A. De Jesus, Miami, FL (US)

( * ) Notice: Subject to any disclaimer, the term of this patent is extended or adjusted under 35 U.S.C. 154(b) by 129 days.

(21) Appl. No.: 17/362,566

(22) Filed: Jun. 29, 2021

Related U.S. Application Data

(63) Continuation-in-part of application No. 16/532,622, filed on Aug. 6, 2019, now abandoned.

(51) Int. Cl.
*A47K 13/30* (2006.01)

(52) U.S. Cl.
CPC ..... *A47K 13/307* (2013.01)

(58) Field of Classification Search
CPC .. E03D 9/04; E03D 9/05; E03D 9/052; A47K 13/307; A47K 13/302
See application file for complete search history.

(56) References Cited

U.S. PATENT DOCUMENTS 4,168,553 A * 9/1979 Studer ..... E03D 9/052 4/348
4,620,329 A * 11/1986 Wix ..... E03D 9/052 4/213
5,105,479 A * 4/1992 Ross ..... E03D 9/05 4/213
5,199,111 A * 4/1993 Antepenko ..... E03D 9/052 4/209 R
5,991,934 A * 11/1999 Hsu ..... A47K 13/307 4/213
9,924,841 B1 * 3/2018 Luquin ..... E03D 9/007
2006/0195975 A1 9/2006 Kirby
2007/0169255 A1 * 7/2007 Benkhardt ..... A47K 13/24 4/234
2009/0188026 A1 * 7/2009 Rosswaag ..... A47K 13/307 4/213

FOREIGN PATENT DOCUMENTS

GB 2143872 A * 2/1985 ..... A47K 13/307
KR 20110054379 A * 5/2011

* cited by examiner

*Primary Examiner* — Erin Deery
(74) *Attorney, Agent, or Firm* — Sanchelima & Associates, P.A.; Christian Sanchelima; Jesus Sanchelima

(57) ABSTRACT

A toilet seat assembly for expelling unwanted odors. The toilet seat includes a suction assembly associated with the toilet bowl. The toilet seat assembly includes a series of suction holes leading from the top surface and extending towards the bottom surface of the toilet seat a predetermined amount. The toilet seat assembly also includes a passageway underneath the series of holes which creates a path that leads towards the suction assembly exit for proper disposable of odors and fluids. The suction assembly leads unwanted odors away from the vicinity of the toilet bowl through a suction hose which permits suction from a vacuum to occur. The suction from the vacuum draws odors beginning from the series of holes found in the toilet seat assembly.

20 Claims, 4 Drawing Sheets

TOILET SEAT HAVING SUCTION ASSEMBLY

OTHER RELATED APPLICATIONS

The present application is a continuation-in-part of pending U.S. patent application Ser. No. 16/532,622, filed on Aug. 6, 2019, which is hereby incorporated by reference.

BACKGROUND OF THE INVENTION

Field of the Invention

The present disclosure generally relates to a toilet seat; and particularly, to a toilet seat with a suction assembly to remove odorous air from the toilet bowl and discharge such air at a remote location.

Description of the Related Art

A toilet seat is typically an integrated body (i.e., a cast single piece) with a bowl and a rim. Water, either from a reservoir or a pipe, is piped through the integrated body to outlets beneath the rim when the toilet is flushed. A drain pipe is formed in the integrated body and leads from the bowl to a sewer line. Even though the bathroom experience is often a brief one, it is still unpleasant as the odors inherently created while using the bathroom are unpleasant for most people, and severely unpleasant for some. The problem is also compounded by the fact that bathrooms are frequently small, which leads to the odors being concentrated. In addition, unpleasant odors are also a problem in public restrooms, and bathroom users generally have even less tolerance for odors created by others in a public setting than they do in their own home. Therefore, it is desirable to remove, eliminate or neutralize odors produced when a toilet is in use. Accordingly, some solutions have been developed for arresting and/or containing odors from the vicinity of a toilet seat.

Traditionally, the solutions have been aimed to provide a satisfactory ventilated toilet. This involves using toilet deodorizers and extractor fans, whether they be wall mounted or ceiling mounted, which go some way to removing or at least disguising the odors. For instance, WIPO Publication Number 2004038115 relates to a sanitary ware. The sanitary ware has a deodorization function, which can diminish the displeasure created by the bad smell and enhance the cleanliness of the toilet because the smell is compulsorily vented through the waste pipe of the sanitary ware after compulsorily inhaling the smell that is generated during bowel movement by placing an electronic backflow cutoff valve for preventing the backflow of the smell and a suction pump to the smell suction hose after connecting the seat and the waste line of the sanitary ware with the smell suction hose provided. However, most of the ventilating systems are unsatisfactory because they do not act to remove the odors at the source, namely in the vicinity of the toilet seat, they are sometimes only partly effective or slow in their effect.

Another, proposed solutions involves using filter systems to remove odors from the bowl of the toilet and scrub them with a filter before releasing the air back into the room. For instance, US Patent Publication Number 20060195975 discloses an apparatus which relates to exhausting noxious odors from the vicinity of a toilet. The invention comprises a means of taking in air from the vicinity of the toilet, a filter, and a means of inducing the air flow. The air is taken in by said means of taking in air, passed on to and through the filter, and then passed on to the means of inducing air flow. The air is then discharged from the system. The filter is separate and unitary and can be installed and removed without exposure of the filtering matrix within the filter. However, any use of filters involves the costs of buying and replacing or regenerating filters.

Another set of proposed solutions involve using a pump system for removing odors from a toilet bowl to outside of the lavatory. Typically, the odors are pumped to the exterior of the building. This solution requires architectural improvements to be made to the building to allow for passages through which to pump the odor-filled gas.

Therefore, there is a need to provide a toilet seat or some means therefor which addresses the problem of odors left behind after someone has used the toilet in an efficient and inexpensive manner. Documents describing the closest subject matter provide for a number of more or less complicated features that fail to solve the problems described above in an efficient and economical way. None of the documents suggest the novel features of the present invention.

SUMMARY OF THE INVENTION

It is one of the objectives of the present invention to provide a toilet seat with an integrated suction assembly which addresses the problem of odors left behind after someone has used the toilet by removing the odors near their source than is presently achieved with toilet deodorizers and extractor fans mounted in the perimeter of the room.

It is another objective of the present invention to provide a toilet seat with a suction assembly to be retro-fitted to an existing commode or the like.

It is yet another objective of the present invention to provide a toilet seat with a suction assembly which has a minimal number of parts, is inexpensive to manufacture, and is easy to install.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
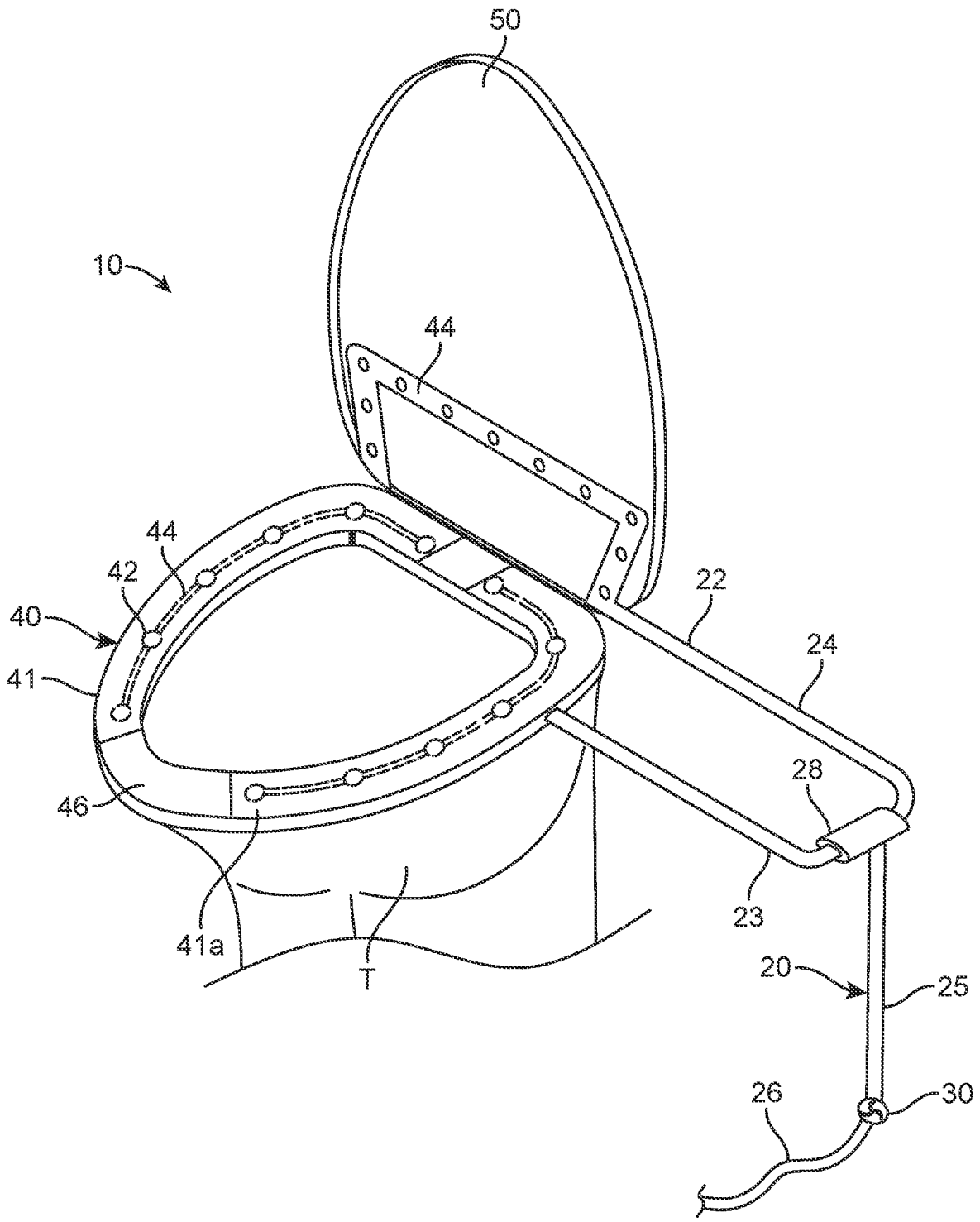
FIG. 1 illustrates a view of the present invention 10 with a suction assembly 20 toilet seat assembly 40 and toilet bowl T, in accordance with one or more embodiments of the present invention.
Figure 2:
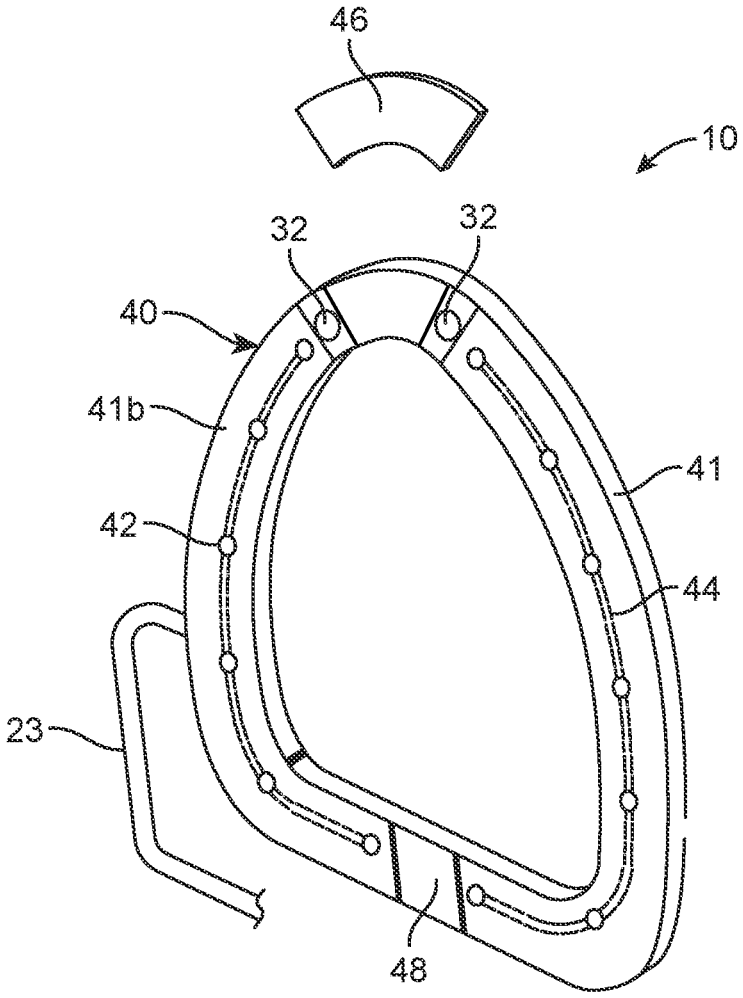
FIG. 2 illustrates a top isometric view of the toilet seat assembly 40 showing suction openings 42 and an example of a passage 44 that the suctioned air can take when returning to suction assembly 20. Tray 46 is also shown exploded at the front end of toilet seat assembly 40.

Referring to the drawings, FIGS. 1-2 illustrate diagrammatic views of the present invention 10 with a suction assembly 20 and toilet seat assembly 40, in accordance with one or more embodiments of the present disclosure.

Figure 3:
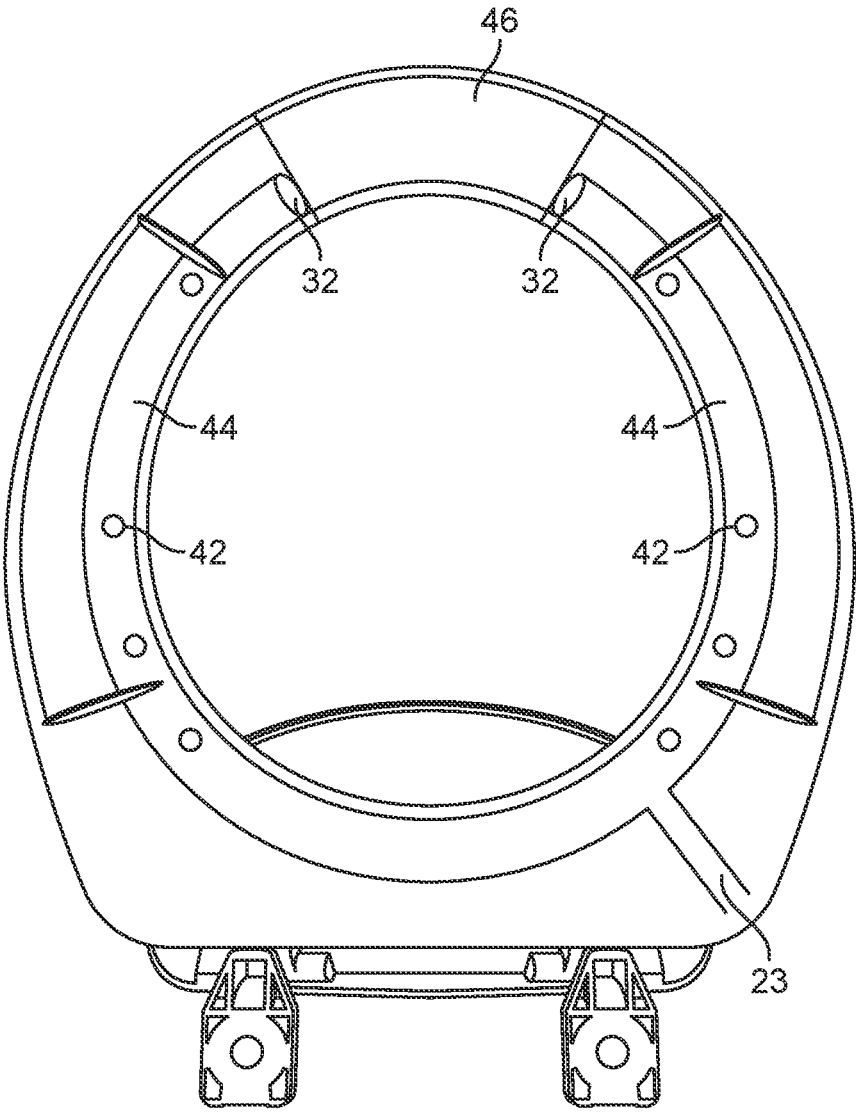
FIG. 3 illustrates a rear view of seat 41 depicting bottom surface **41*b* with passage 44 embedded within the seat 41. First hose portion 23 is also shown extending within the seat and coupling to the passage 22**.
Figure 4:
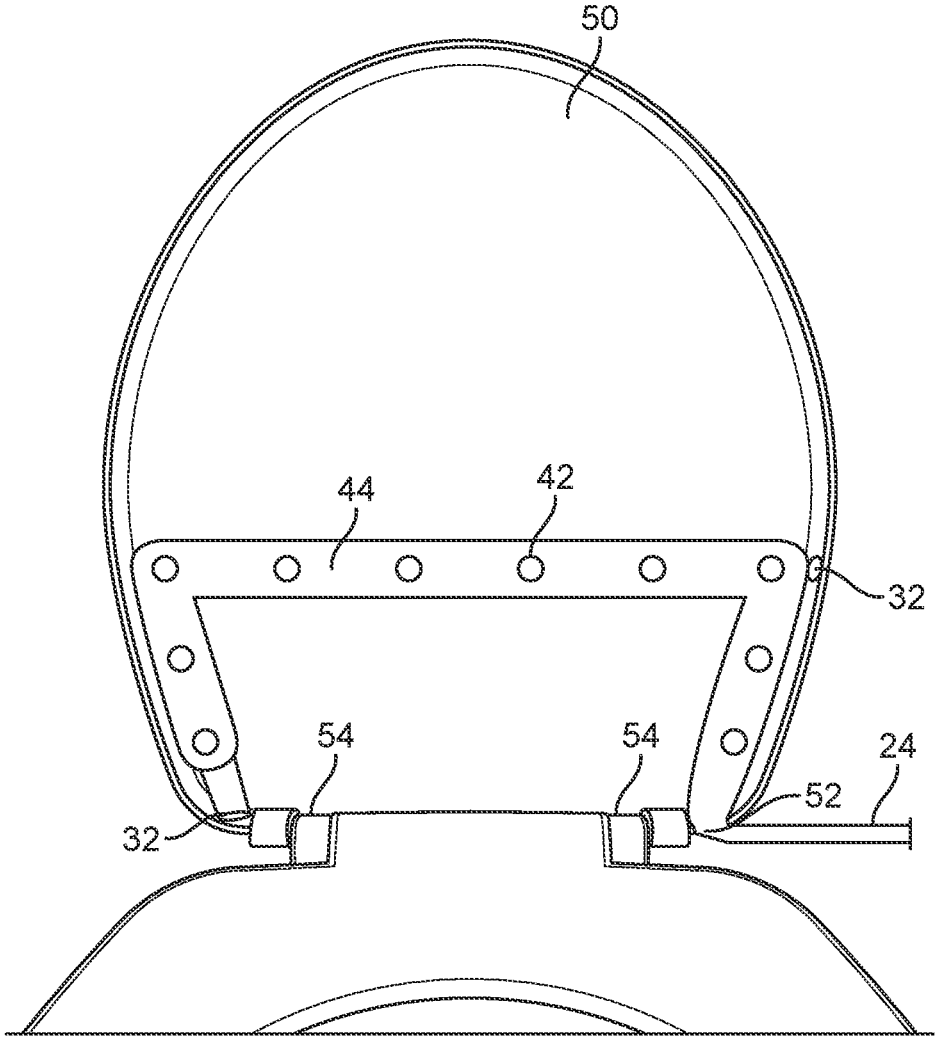
FIG. 4 illustrates a front view of lid 50 of toilet seat assembly 40 depicting passage 44 with openings 42 embedded within the lid 50. Mounting portion 52 is also shown in coupling engagement with second hose portion 24.

FIGS. 3-4 illustrate alternate examples of the toilet seat assembly 40.

In order for the present invention to be able to extract unpleasant odors and smells from toilet seat assembly 40 suction assembly 20 may be used. Suction assembly 20 further includes a suction hose 22, a hose connector 28, and a vacuum 30. Suction hose 22 may extend partially into a seat 41. Suction hose 22 may be inserted straight into seat 41 or suction hose 22 may be inserted into seat 41 at an angle or slanted. Suction hose 22 further includes a first hose portion 23, a second hose portion 24, a third hose portion 25 and a fourth hose portion 26. Hose connector 28 may have a plurality of openings as to allow hose connector 28 to receive a plurality of hoses. In the immediate embodiment, hose connector 28 includes three openings that corresponds with the amount of hoses it may receive. Hose connector 28 may have an opening on a left side, a right side and a top side as seen in the immediate embodiment. It can be appreciated that the number of openings found on hose connector 28 may not be limited to three, any other number of openings may be suitable for hose connector 28. Each portion of suction hose 22 may be a smaller hose that is used to connect to other portions of suction hose 22.

First hose portion 23 is received and mounted to hose connector 28 on one end and first hose portion 23 is also mounted to seat 41 along an outer edge thereof. Second hose portion 24 is received and mounted to hose connector 28 on one end and second hose portion 24 is also mounted to a lid 50 along a mounting section 52 thereof. First hose portion 23 and second hose portion 24 are communicably attached by hose connector 28 to allow scents to be drawn out by vacuum 30 through suction hose 22. Third hose portion 25 may attach to hose connector 28 on one end, preferably to the top side of hose connector 28, and to vacuum 30 on an opposite end. Suction connector 28 communicably interconnects first hose portion 23, second hose portion 24 and third hose portion 25. Fourth hose portion 26 may be mounted to vacuum 30 on one end and the opposite end may lead to a vent or outside of a building. Fourth hose portion 26 may be used to expel scents or smells out and away from a bathroom and the immediate vicinity of a toilet.

All portions of the hose portions may combine together to assemble suction hose 22. Alternatively, suction hose 22 may be one whole piece that does not separate into smaller hose portions or sections. Thereby meaning that in an alternate embodiment there may be no need for hose connector 28. Suction hose 22 leads all scents out and away from toilet seat assembly 40. First hose portion 23 and second hose portion 24 may be curved as to be able to corporate with being mounted around and behind a water tank of a toilet. Third hose portion 25 may be mounted against a wall as to run vertically or horizontally depending on the needs of a user, in an alternate embodiment. It should be understood that all portions of suction hose 22 mount to necessary components by known means in the art of attaching or mounting. That is through screws, fasteners, hook and loop straps, adhesives or the like.

Suction assembly 20 importantly may use vacuum 30 to withdraw scents and odors. Vacuum 30 may be any suction means known in the art that will inhale or suction. Vacuum draws the scents from the vicinity of toilet seat assembly 40. The scents may then travel through suction assembly 20 and out towards a vent, for example. In order for the suction of vacuum 30 to be effective, there is a need for stoppers 32 and as well as a solid seat portion 48. These two elements create a seal in order for the suction of vacuum 30 to be effective. Stoppers 32 create seals at one end of each of a passage 44. While solid seat portion 48 creates a seal at an opposite end of each of passage 44. This permits the suctions from vacuum 30 to travel a defined path which allows for effective expelling or removal of unwanted scents. Passage 44 may be adapted to receive a brush therethrough as to allow cleaning of passage 44. The brush or any other cleaning means may extend through each of passage 44 up until solid seat portion 48 is reached.

Toilet seat assembly 40 includes seat 41 that can be removably mounted over a toilet bowl T using conventional methods. Seat 41 can be hingedly or integrally mounted to toilet bowl T. Seat 41 may be constructed of ceramic, metal, wood, plastic or any other suitable aesthetic material. Seat 41 includes a plurality of suction openings 42 along most of its circumference. Suction openings 42 may be openings that are vertical, but preferably that are slanted. Suction openings 42 may be slanted inwardly or outwardly. The interruptions in the placement of suction openings 42 are due to tray 46 at the front of seat 41 and suction hose 22 at the rear of seat 41. Suction openings 42 are of a size that cooperate with suctioning an effective amount of ambient air at an efficient rate. Seat 41 has a thickness and an interior space therein. Passage 44 can be within a tube or without a tube and just the directional flow of the suctioned air within an interior of seat 21. Such tubing when used may be made of polyurethane or other suitable plastic or flexible materials. Seat 41 includes a top surface 41*a* and suction openings 42 can be placed thereon. Seat 41 also includes a bottom surface 41*b* that is sealed to provide the necessary vacuum effect within the interior space of seat 41, more specifically, within passage 44. In an alternate embodiment, bottom surface 41*b* can include suction openings 42 and top surface 41*a* can be sealed to create the same vacuum effect.

Tray 46 is located at the front end of seat 41 and can extend from top surface 41*a* to bottom surface 41*b*. There can be a partition that seals and/or separates tray 46 from interior space of seat 41 or tray 46 can be fluidly connected with the interior space of seat 41. Tray 46 can also include a handle that allows users to easily open and close it. Tray 46 can also function as a lid that is lifted and lowered off at least partially off of seat 41. Tray 46 is opened to provide a user access to clean an interior space of seat 41 using a brush, sponge, cloth, or similar means. Tray 46 can be larger or smaller than how it is portrayed in FIG. 2. Upon suction assembly 20 being actuated, the ambient air, having the odor intended to be removed, is suctioned through suction openings 42 and follow a passage 44 to return back to suction assembly 20 through the rear of seat 41. In different embodiments, more or less suction openings 42 can be used.

Toilet assembly 40 further includes a lid 50 as observed in FIG. 4 of the provided drawings. It can be observed that lid 50 is operatively engaged with seat 41 with hinges 54. Additionally, passage 44 is embedded within lid 50. It can be observed that passage 44 within the lid 50 is formed into an n-shaped configuration and includes opposing distal ends which are adjacent to the hinges 54 of the lid 50. Passage 44 of the lid 50 further includes openings 42 that are exposed from the bottom surface of the lid 50. Additionally, passage 44 further includes stopper members 32 operative engaged onto the passage 44 and exposed along the edge of the lid 50. In the present embodiment, stoppers 32 are removable in order to provide access to the interior of passage 44 and thereby allowing a user to clean passage 44. The lid 50 further includes a mounting section 52 located adjacent to the hinges 54. The second hose portion 24 is then operatively engaged to the mounting section 52 of lid 50 in order establish fluid communication with passage 44 embedded within lid 50.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A toilet seat system comprising:

a) a toilet seat assembly mounted to a toilet bowl, wherein said toilet seat assembly includes a seat having a circumference, a top surface, a bottom surface, and an interior space between said top surface and said bottom surface forming a passage, wherein said seat includes a plurality of suction openings located at least partially along said circumference which extend into the passage, said seat further including a tray removably mounted thereto, said tray being located at a front side of said seat, said tray selectively permitting access to an interior of said passage for cleaning thereof, said tray extending partially along the circumference of said seat, said toilet seat assembly further including a lid having a lid passage embedded therein, said lid passage having an n-shaped configuration, said lid passage further including at least two lid stopper members;

b) a suction assembly in communication with said toilet seat assembly, said suction assembly suctions ambient air through said suction openings, said suction assembly further includes a suction hose, a hose connector, and a vacuum, said suction hose further includes a first hose section, a second hose section, a third hose section, and a fourth hose section, said first hose section being operatively coupled to the seat and extends from the passage of the seat, said second hose section being operatively coupled to the lid and extends from the lid passage of the lid.

2. The toilet seat system of claim 1 wherein said plurality of suction openings are located on said top surface.

3. The toilet seat system of claim 1 wherein said plurality of suction openings are located on said bottom surface.

4. The toilet seat system of claim 1 wherein said plurality of suction openings extend along a majority of said circumference.

5. The toilet seat system of claim 1 wherein said ambient air follows said passage within said interior space.

6. The toilet seat system of claim 1 wherein said tray further includes stoppers, said stoppers creating a seal for said passage at the front side of said seat and said passage.

7. The toilet seat system of claim 6, wherein said stoppers are adjacent to said passage.

8. The toilet seat system of claim 6, wherein said stoppers are wider than each of said plurality of suction openings.

9. The toilet seat system of claim 1 wherein said top surface includes a width and said suction openings are entirely within said width.

10. The toilet seat system of claim 1, wherein said toilet seat assembly includes a solid seat portion adapted to create a seal within said passage.

11. The toilet seat system of claim 10, wherein said tray is located on said seat opposite to said solid seat portion.

12. The toilet seat system of claim 10, wherein said passage is interrupted by said tray and said solid portion along the circumference of said seat.

13. The toilet seat system of claim 1, wherein said suction assembly is entirely above of said toilet bowl.

14. The toilet seat system of claim 1, wherein the circumference includes an inner circumference and an outer circumference, and wherein said tray extends entirely between the inner circumference and the outer circumference.

15. The toilet seat system of claim 1, wherein said tray includes a curvature that cooperates with a shape of said seat, said curvature extending towards said passage, said tray being engaged with the seat via pressure.

16. The toilet seat system of claim 1, wherein said plurality of suction openings are wider than said passage.

17. The toilet seat system of claim 1, wherein said tray is located at an underside of said seat and is flush with said bottom surface.

18. The toilet seat system of claim 1, wherein a second end of each of said first hose section and second hose section mounted to said hose connector, said third hose is mounted to said hose connector on one end and said vacuum on an opposite end.

19. The toilet seat system of claim 18, wherein said hose connector communicably interconnects said first, second and third hose portions as to allow suction from said vacuum to flow therethrough, said fourth hose portion expels odors suctioned by said vacuum away from a vicinity of the toilet bowl.

20. A toilet seat system, consisting of:

a) a toilet seat assembly mounted to a toilet bowl, wherein said toilet seat assembly includes a seat having a circumference, a top surface, a bottom surface, and an interior space between said top surface and said bottom surface forming a passage, wherein said seat includes a plurality of suction openings located at least partially along said circumference which extend into the passage, said seat further including a tray removably mounted thereto, said tray being located at a front side of said seat, said tray selectively permitting access to an interior of said passage for cleaning thereof, said tray extending partially along the circumference of said seat, said toilet seat assembly further including a lid having a lid passage embedded therein, said lid passage having an n-shaped configuration, said lid passage further including at least two lid stopper members; and b) a suction assembly in communication with said toilet seat assembly, said suction assembly suctions ambient air through said suction openings, said suction assembly further includes a suction hose, a hose connector, and a vacuum, said suction hose further includes a first hose section, a second hose section, a third hose section, and a fourth hose section, said first hose section being operatively coupled to the seat and extends from the passage of the seat, said second hose section being operatively coupled to the lid and extends from the lid passage of the lid, wherein a second end of each of said first hose section and second hose section mounted to said hose connector, said third hose is mounted to said hose connector on one end and said vacuum on an opposite end, wherein said hose connector communicably interconnects said first, second and third hose portion as to allow suction from said vacuum to flow therethrough, said fourth hose portion expels odors suctioned by said vacuum away from a vicinity of the toilet bowl.

* * * * *